US011407546B2

(12) United States Patent
Choplin et al.

(10) Patent No.: US 11,407,546 B2
(45) Date of Patent: Aug. 9, 2022

(54) DEVICE FOR HEATING WRAPPED BATCHES OF PRODUCTS AND INSTALLATION FOR PACKAGING BY FILM WRAPPING BATCHES OF PRODUCTS

(71) Applicant: C.E.R.M.E.X. CONSTRUCTIONS ETUDES ET RECHERCHES DE MATERIELS POUR L'EMBALLAGE D'EXPEDITION, Corcelles-les-Citeaux (FR)

(72) Inventors: Grégory Choplin, Corcelles-les-Citeaux (FR); François-Régis De Brunier, Corcelles-les-Citeaux (FR)

(73) Assignee: C.E.R.M.E.X. CONSTRUCTIONS ETUDES ET RECHERCHES DE MATERIELS POUR L'EMBALLAGE D'EXPEDITION, Corcelles-les-Citeaux (FR)

( * ) Notice: Subject to any disclaimer, the term of this patent is extended or adjusted under 35 U.S.C. 154(b) by 202 days.

(21) Appl. No.: 16/839,051

(22) Filed: Apr. 2, 2020

(65) Prior Publication Data

US 2020/0317381 A1 Oct. 8, 2020

(30) Foreign Application Priority Data

Apr. 2, 2019 (FR) ..... 1903487

(51) Int. Cl.

| | |
|---|---|
| ***B65B 53/06*** | (2006.01) |
| ***B65B 11/02*** | (2006.01) |
| ***B65B 35/30*** | (2006.01) |

(52) U.S. Cl.

CPC ..... *B65B 53/063* (2013.01); *B65B 11/02* (2013.01); *B65B 35/30* (2013.01); *B65B 2220/24* (2013.01)

(58) Field of Classification Search

CPC ..... B65B 53/063; B65B 11/02; B65B 35/30; B65B 2220/24; B65B 59/00; B65B 13/18; B65B 53/06; B65B 53/00

See application file for complete search history.

(56) References Cited

U.S. PATENT DOCUMENTS 3,668,817 A * 6/1972 Bell ..... B65B 53/063 53/397
5,205,274 A * 4/1993 Smith ..... H05B 6/6411 126/21 A (Continued)

FOREIGN PATENT DOCUMENTS

| | | |
|---|---|---|
| CN | 207208656 U | 4/2018 |
| EP | 1288129 A2 | 3/2003 |
| EP | 2319769 A1 | 5/2011 |

OTHER PUBLICATIONS

French Search Report for French Patent Application No. 1903487, dated Aug. 9, 2019.

*Primary Examiner* — Thomas M Wittenschlaeger
*Assistant Examiner* — Katie L Gerth

(57) ABSTRACT

A device for heating wrapped batches of products and a packaging installation provided with such a heating device, specifically having a manifold of heating elements with lines of orifices and a blocking device for the orifices using a mobile plate having for each line of orifices openings, at least two successive openings having different lengths, to go the direction of movement a) from a position blocking at least a first line of orifices and opening at least a second line of orifices, b) to another position opening the first line of orifices whilst maintaining open the second line of orifices.

12 Claims, 3 Drawing Sheets

(56) References Cited

U.S. PATENT DOCUMENTS

| | | | | |
|---|---|---|---|---|
| 5,218,998 | A * | 6/1993 | Bakken | F24F 13/12 137/625.28 |
| 6,467,190 | B2 * | 10/2002 | Nagel | F26B 21/026 34/218 |
| 6,689,180 | B1 * | 2/2004 | Liao | B65B 53/063 34/211 |
| 7,079,387 | B2 * | 7/2006 | Brooks | G06F 1/20 165/185 |
| 2003/0044744 | A1 * | 3/2003 | Nava | B65B 53/063 432/121 |
| 2006/0073780 | A1 * | 4/2006 | Motszko | B60H 1/00692 454/74 |
| 2013/0337737 | A1 * | 12/2013 | DeVarney | F17C 13/084 454/347 |
| 2015/0140922 | A1 * | 5/2015 | Babur | F24F 13/12 454/298 |

* cited by examiner

DEVICE FOR HEATING WRAPPED BATCHES OF PRODUCTS AND INSTALLATION FOR PACKAGING BY FILM WRAPPING BATCHES OF PRODUCTS

TECHNICAL FIELD

The present invention falls within the field of packaging products on a line for production and processing of said products.

BACKGROUND

Products may be, in a non-limiting way, containers such as bottles, cans, drink cartons, or again such containers individually or grouped in boxes, crates, cartons or loads.

In known manner, on an industrial line, products may undergo a plurality of successive different treatments, ranging from the production of the container by an operation of plastic injection moulding or drawing-blowing, in particular via filling, closing by a cap and labelling of the products individually, up to packaging in batches of a plurality of grouped products.

Moreover, each batch is made up by grouping, in a quincunx or otherwise, a plurality of products in accordance with a matrix disposition, generally of globally parallelepipedal square or rectangular shape. In a complementary way, each batch may be held at the bottom by means of a support forming a base, for example a cardboard tray.

Once the products have been grouped into batches, each batch may be wrapped, in particular covered with a film in order to hold the products together and to facilitate handling such a batch.

SUMMARY OF THE INVENTION

The invention is directed to packaging by film wrapping a plurality of products grouped into batches.

Film wrapping products consists in grouping them into batches and then wrapping each batch of products by means of a sheet of a heat-shrink material film. A wrapped batch then undergoes a heating step so that the sheet comes to espouse the overall outside shape of the batch. To summarize, the sheet of film is shrunk by the effect of the heat to produce a shrinkage that secures the products grouped into batches.

Grouping into batches, wrapping and heating are carried out by means of a dedicated film wrapper type device via a plurality of successive stations.

Furthermore, the heating of a wrapped batch is effected when passing through an oven, of tunnel oven type. Each batch of products is transported on the upper face of one or more conveyors from the entry to the exit of said oven.

The same oven may comprise a plurality of distinct sections, butted up one after the other, each conferring dedicated heating parameters on each batch passing through said oven. In particular, heating is effected by heating means circulating a flow of heated air toward the interior of the sections of said oven, preferably a heating means specific to each section. On the one hand, hot air is directed toward the conveyor and enables heating of the underside and the lower edges of the batches transported on the conveyor, essentially aiming at the part of the sheet of film situated under the batch of products, with a view in particular to welding the edges of the wrapping sheet which, at the preliminary wrapping stage, are superposed and pressed one against the other under the weight of the products of the batch. On the other hand, hot air is directed toward the interior volume of the enclosure and enables heating of the exterior of the wrapped batch, with a view to shrinking the sheet of film so that shrinking it presses it into contact with the products, deforming the sheet so that it comes to espouse a part of the contours.

Furthermore, each heating means comprises a heating unit the function of which is to heat the air that passes through it. A heating means also comprises a means for circulating the air heated by said heating unit in the form of a flow of heated air. At the outlet, this flow of heated air is directed toward a circuit dividing and discharging, on the one hand, at the level of the conveyor of its section and, on the other hand, inside the volume of the enclosure of that same section.

In the latter case, the expulsion of the heated air at the outlet of the corresponding circuit toward the interior of the volume of the enclosure is effected via manifolds. Such manifolds may consist of the vertical lateral walls of the interior of the enclosure of each section of the oven, or take the form of an independent element positioned inside the enclosure of each section.

Preferably, at least two manifolds are disposed vertically and parallel to one another, extending longitudinally in the direction of movement of the batches, over a portion of the length of each section. Two manifolds are spaced transversely by an interval, on the one hand, allowing the passage of the batches between said two manifolds and, on the other hand, a particular distance relative to the lateral walls of the batches, in order to perform the heating and the shrinkage.

Furthermore, each manifold has a hollow and closed, globally parallelepipedal rectangular or trapezoidal shape. Each manifold is connected to the outlet of the circuit via which the flow of heated air arrives and has a wall with orifices through which the hot air is expelled and directed toward the interior of the volume of its section. Such orifices are generally identical, having a circular section, and are also generally distributed regularly over the surface of the wall of each manifold.

In this regard, generally speaking, the orifices may be distributed in lines forming rows of orifices aligned horizontally and columns of orifices aligned vertically. Two adjacent rows comprise orifices spaced vertically by a step of given height. Concerning the rows, two adjacent orifices of the same row are spaced by a horizontal centre distance of particular length, determining the columns. In other words, each of the orifices of a row is aligned vertically with the corresponding orifice of one or more adjacent rows above and/or below it, forming columns of a regular lattice.

In order to improve the distribution of the air expelled via each wall of a manifold, in accordance with another quincunx configuration, the orifices of two adjacent rows may be offset horizontally. In other words, a row has orifices not belonging to the columns of the orifices of the adjacent row or rows.

In this context, as a function of the format of the products to be processed, it may be necessary to block certain lines of orifices, generally by closing the orifices of one or more rows or columns. Preferably, as a function of the height of the products to be processed, it may be necessary to close the rows of orifices situated in the upper part of a manifold; the orifices situated in the lower part then remaining open.

To this end, in known manner, a solid plate is mounted to be mobile relative to the wall provided with orifices in such a manner as to come face-to-face with the latter and to close them. Preferably, a plate is mounted to be mobile vertically, its descent blocking the rows of orifices one by one, and vice-versa.

However, in order to block all the orifices, the plate must have a dimension equivalent to the wall of the manifold: the maximum amplitude of the movement of a single plate is then effected along a travel necessitating a corresponding space inside the device, which has to be sized accordingly.

Because of this constraint, the dimension of said plate is limited, its movements enabling simultaneous blocking of only certain rows or columns of orifices. Preferably, the reduced height of the plate enables blocking of only certain rows of orifices, in particular freeing the upper rows if the plate has to block the orifices situated in the middle and in the lower part of the wall of the manifold.

To enable line by line blocking of the orifices, it is then necessary to envisage a plurality of independent mobile plates with corresponding actuators controlling their movement, increasing the complexity, the cost and also the weight of each manifold.

One alternative lies in a plate provided with openings distributed in alignments corresponding to the lines of orifices to be blocked. Said openings have dimensions equivalent to those of the orifices, in particular the same diameters. Accordingly, by moving the plate over a reduced travel, equivalent to said diameter, it is possible to open or to block all the orifices simultaneously. Once again, to envisage the selective blocking of lines of orifices, it is necessary to multiply the plates, leading to the same disadvantages.

The invention starts from this observation and its object is to alleviate the disadvantages of the prior art by proposing the ability to control the blocking of the successive lines of orifices through at least one wall of a manifold with a maximum amplitude of its travel that is limited, in particular not leading to modification of the sizing of the enclosure of the heating device.

To do this, the invention envisages forming openings at the level of at least one plate of blocking means of a manifold, said openings in particular having specific dimensions as a function of the diameter of the orifices and of their centre distance.

To this end, the invention has for subject matter a device for heating wrapped batches of products, comprising at least:

an oven provided with at least one section;

at least one conveyor of said wrapped products passing through said at least one section;

means for heating said at least one section;

the heating means comprising at least one heating unit, at least one circuit connecting said heating unit and discharging inside said at least one section, and at least one means for circulating a flow of air heated by said heating unit to said circuit;

for each section, each heating means comprising at least one manifold connected to the outlet of at least said circuit, each manifold extending along at least a part of said corresponding section;

said at least one manifold comprising at least one wall provided with orifices of equivalent sizes, said orifices being distributed in lines on the surface of said wall, the lines of orifices extending horizontally forming rows, the lines of orifices extending vertically forming columns, the adjacent orifices of the same line being spaced by at least one particular centre distance;

at least one means for blocking the orifices of at least two lines comprising at least one plate mobile in at least one direction of movement relative to said wall of said manifold, said plate comprising for each line of orifices openings spaced by an interval, each opening having a length at least equivalent to the size of an orifice.

The heating device having at least two successive openings have different lengths, to go in said movement direction a) from a position blocking at least a first line of orifices and opening at least a second line of orifices, b) to another position opening said first line of orifices whilst maintaining open said second line of orifices, and vice-versa.

In accordance with additional, non-limiting features, for each line of orifices, said corresponding openings may form an alignment in said direction of movement of said plate or transversely to said direction of movement of said plate;

said at least two successive openings with different lengths may belong to the same alignment.

The interval between at least the openings corresponding to two successive lines of orifices may be a function of said at least one centre distance and of at least one of the sizes of an orifice of said two lines.

Said interval is equivalent to said at least one centre distance, reduced by one of the sizes of an orifice of one of said two lines.

For at least first and second successive lines of orifices, the openings corresponding to said second line may have a length equivalent to the length of the openings corresponding to said first line, increased at least by one of the sizes of an orifice of one of said first or second lines.

Said plate may be mobile vertically in said direction of movement, each alignment of the openings corresponding to each column.

Said plate may be mobile horizontally in said direction of movement, each alignment of openings corresponding to each row.

Said plate may be mobile horizontally in said direction of movement, each alignment of openings corresponding to each column, and the lengths of the openings extend horizontally.

The orifices of two adjacent rows (or columns) may be offset horizontally (or vertically).

The openings corresponding to one of the lines of orifices may discharge through an edge of said plate.

Said plate may be mobile by a movement step at least equivalent to the size of the orifices.

The interval between the openings of the same alignment and the length of the openings may be adapted as a function of the centre distances between the orifices and of the sizes of the orifices.

The invention also concerns an installation for packaging by film wrapping batches of products, comprising successively at least:

a station for grouping said products into batches;

a station for wrapping each of said batches using a sheet of heat-shrink film;

a station for heating each sheet wrapping each batch;

a station for cooling the sheet of each batch.

Such a packaging installation is characterized in that said heating station comprises at least one device for heating wrapped batches of products according to the invention.

Accordingly, by way of a contained travel, the dedicated openings of the invention enable successive freeing or blocking of the lines of orifices. The invention in particular enables the lines, column or rows of orifices to be opened or closed one by one.

Moreover, the invention enables all the orifices of a manifold to be blocked completely, enabling stopping of the expulsion of air inside the enclosure, without action on the heating means.

Other features and advantages of the invention will emerge from the following detailed description of nonlimiting embodiments of the invention with reference to the appended figures.

DETAILED DESCRIPTION

Figure 1:
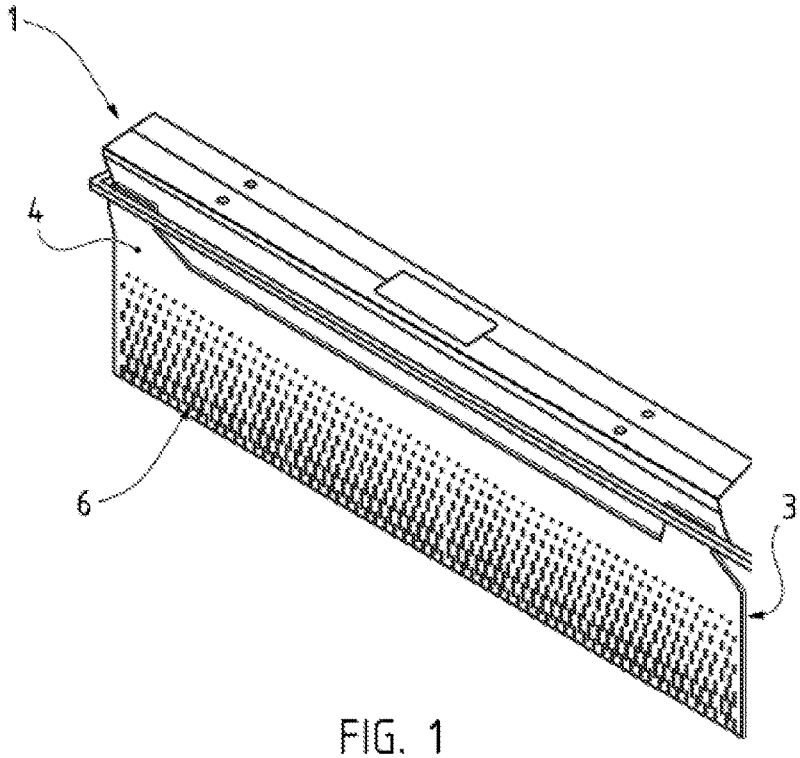
FIG. 1 illustrates a perspective view of a detail of one embodiment of the heating device according to the invention, showing a manifold equipped with a wall for blocking its orifices.

The present invention concerns the packaging of products on a line for production and processing of said products.

Said products may be, in a non-limiting way, containers such as bottles, cans, drink cartons, or again such containers individually or grouped in boxes, crates, cartons or loads.

In known manner, on an industrial line, products may undergo a plurality of successive different treatments, ranging from the production of the container by an operation of plastic injection moulding and/or drawing-blowing, in particular via filling, closing by a cap and labelling of the products individually, up to packaging in batches of a plurality of grouped products.

Moreover, each batch is made up by grouping, in a quincunx or otherwise, a plurality of products in accordance with a matrix disposition, generally of globally parallelepipedal square or rectangular shape. In a complementary way, each batch may be held at the bottom by means of a support forming a base, for example a cardboard tray.

Once the products have been grouped into batches, each batch may be wrapped, in particular covered with a film in order to hold the products together and to facilitate handling such a batch.

The invention is directed to packaging by film wrapping a plurality of products grouped into batches.

Film wrapping products consists in grouping them into batches and then wrapping each batch of products by means of a sheet of a heat-shrink material film. A wrapped batch then undergoes a heating step so that the sheet comes to espouse the overall outside shape of the batch.

This heating operation is effected by means of a device for heating wrapped batches of products.

Such a heating device comprises at least one oven, in particular of tunnel type, provided with at least one section, preferably a plurality of sections butted together one after the other, forming an interior enclosure. Such an enclosure extends from an entry to an exit.

The heating device also comprises at least one conveyor of wrapped products passing through said at least one section. Preferably, a single conveyor passes through all of the enclosure of the oven, from the entry to the exit, in particular extending upstream beyond the entry and downstream beyond the exit. Said conveyor transports on its upper face wrapped batches of products, their bottom resting on it directly or indirectly by way of a support, such as a tray or a carton. Said conveyor then transports the wrapped products in a longitudinal or substantially longitudinal conveying direction.

The heating device further comprises means for heating said at least one section. Such heating means may be dedicated to one section or shared between a plurality of sections. Said heating means comprise at least one heating unit, at least one circuit connecting said heating unit and discharging inside said at least one section and at least one means for circulating a flow of air heated by said heating unit toward said circuit.

Thus the heating means heat the air and cause it to move until it is expelled inside the enclosure of the oven, inside one or more sections.

Furthermore, for each section, each heating means comprises at least one manifold 1 connected to the outlet of at least said circuit. Preferably, each heating means comprises a plurality of manifolds 1, in particular at least one pair of manifolds 1. A manifold 1 extends along at least a part of said corresponding section and can therefore extend along one or more sections.

A manifold 1 may consist of the wall of the oven, extending over all or part of the height of said wall. A manifold 1 may also consist of an independent component positioned inside the enclosure.

Each manifold 1 extends vertically or substantially vertically. A plurality of manifolds 1 of the same heating means, in particular the two manifolds 1 of a pair, extend parallel to one another. Each manifold 1 extends in a longitudinal direction parallel to the direction of conveying the products.

Figure 2:
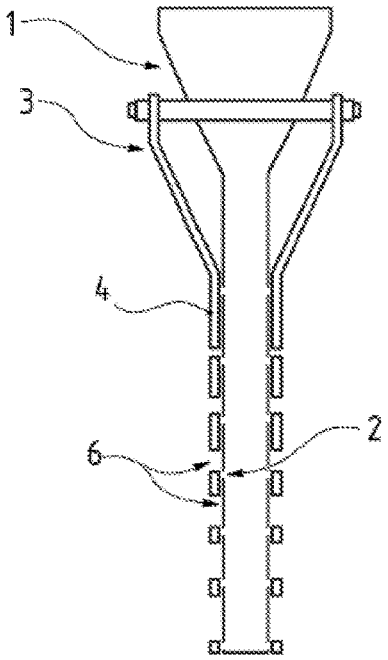
FIG. 2 illustrates a view in vertical cross section of a manifold of the embodiment seen in FIG. 1.

According to one embodiment, each manifold comprises an interior volume enabling the circulation of the heated air. Each manifold is therefore connected to the circuit, providing the connection with its interior volume. This connection of a manifold 1 with the circuit is in particular situated in the top part. Said volume of a manifold can in particular be seen in FIG. 2.

Moreover, said at least one manifold 1 comprises at least one wall provided with orifices 2. The wall is therefore solid between the orifices 2, with the possible exception of certain perforated parts because of structural considerations of mobility or fixing.

In the case of a manifold 1 integrated into a wall of the oven, it is then that wall that is provided with orifices 2. In the case of an independent manifold 1, as can be seen in particular in FIG. 2, it may comprise two parallel or substantially parallel lateral walls: one and/or the other of said lateral walls may be provided with said orifices 2. Preferably, an independent manifold 1 may have a globally parallelepipedal rectangular shape, or even a prismatic shape with a frustoconical face. A manifold 1 may be closed by its peripheral walls, in such a manner as to define an interior volume.

The orifices 2 are through-orifices communicating with the interior volume of each manifold 1 and the interior of the enclosure. Thus air arriving from the circuit circulates inside said volume of each manifold 1 and is expelled inside the enclosure via said orifices 2.

Such orifices 2 may be of equivalent sizes, in particular to within plus or minus a few millimetres. The orifices 2 are generally of circular shape, but may be oblong or of polygonal shape, with rounded or straight edges. The size of an orifice 2 then corresponds to its largest dimension, in particular its diameter.

Preferably, the size of the orifices 2 may be between 2 and 20 millimetres (mm) inclusive, the size of each orifice 2 being in particular 5 mm.

Said orifices 2 are distributed in lines on the surface of said wall of said at least one manifold 1. Preferably, the orifices 2 are distributed regularly on the corresponding wall, but may also be distributed in an irregular manner. A regular distribution consists in particular in an equivalent distance, to within a few millimetres, of the orifices 2 of different lines, in each row or column.

Also, the lines of orifices 2 extending horizontally form rows while the lines of orifices 2 extending vertically form columns. The adjacent orifices 2 of the same line are spaced by at least one particular centre distance. To summarize, the orifices 2 of the same row are spaced horizontally by a given centre distance while the orifices 2 of the same column are spaced vertically by another given centre distance, and these two centre distances may be equivalent or different. It will be noted that in the same line, row and/or column, the orifices 2 may be spaced by equivalent or different centre distances.

In particular, the orifices 2 may form a rectangular matrix, the rows and columns being mutually perpendicular.

Figure 3:
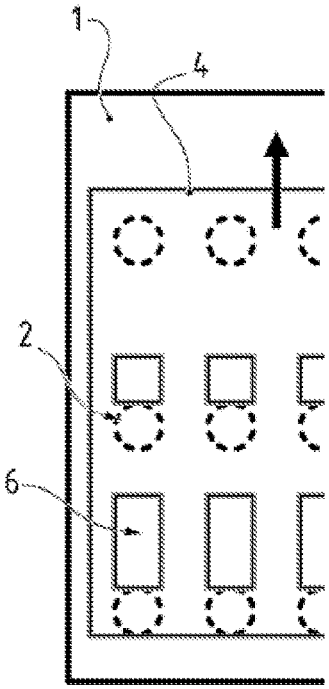
FIG. 3 illustrates a simplified side view of a first embodiment, showing a plate mobile vertically in a first position completely blocking all the orifices of a manifold.
Figure 4:
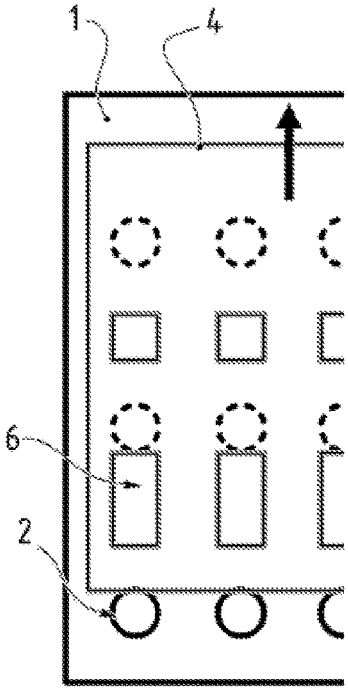
FIG. 4 illustrates said plate of FIG. 3 movement in a vertical direction, in a second blocking position, freeing a lower row of orifices.
Figure 5:
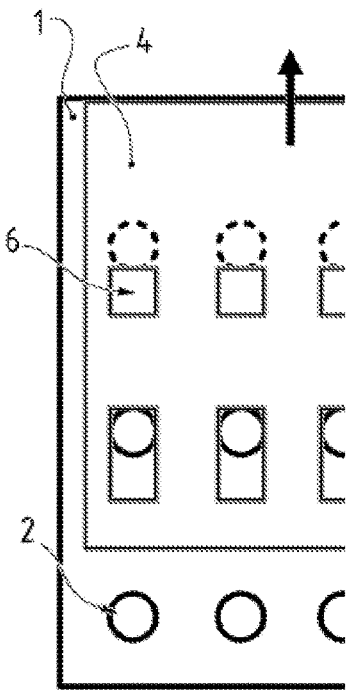
FIG. 5 illustrates said plate of FIGS. 2 and 3 in a third blocking position.
Figure 11:
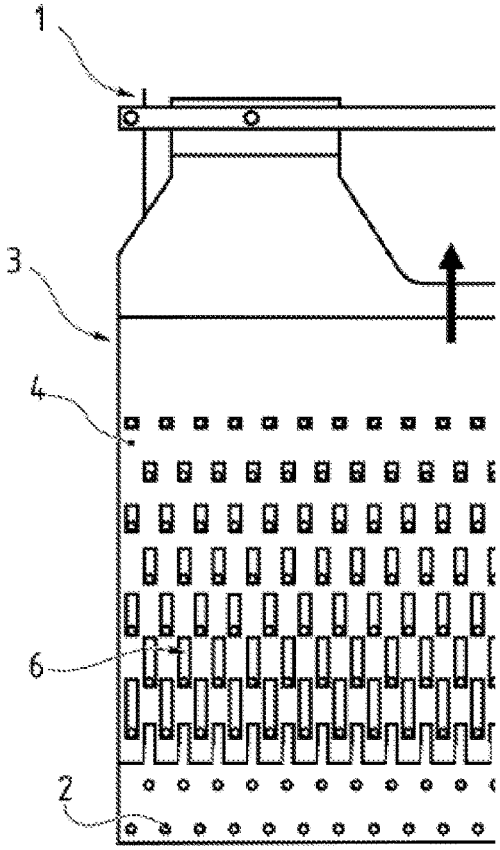
FIG. 11 illustrates the plate of FIG. 10 after another vertical movement, in a position freeing all the orifices of said manifold.

Moreover, two successive lines, in particular two rows one above the other, may be situated in the same alignment, as can be seen in particular in FIGS. 3 to 5, or one may be offset horizontally relative to the other, as can be seen in particular in FIG. 11. To summarize, the orifices 2 of two adjacent rows (or columns) are offset horizontally (or vertically).

The heating device comprises at least one means 3 for blocking the orifices 2 of at least two lines. Such a blocking means comprises at least one plate 4.

Said plate 4 is positioned in the vicinity of the wall of the manifold 1 provided with the orifices 2, preferably back to back and in contact.

Figure 7:
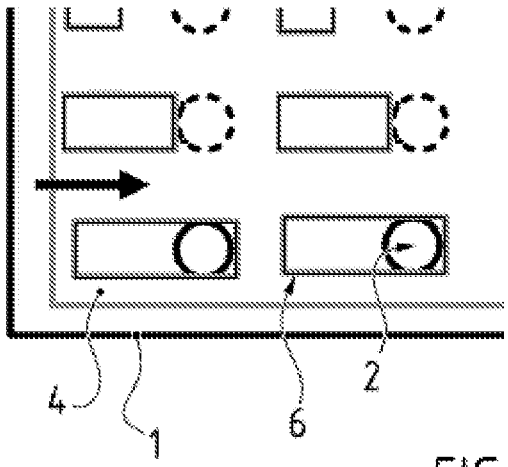
FIG. 7 illustrates a simplified side view of another embodiment, showing a plate mobile horizontally in a first blocking position.
Figure 8:
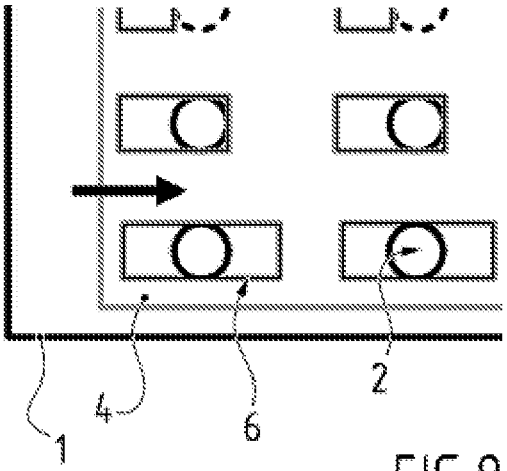
FIG. 8 illustrates the manifold of FIG. 7 in another blocking position after movement in a horizontal direction.
Figure 9:
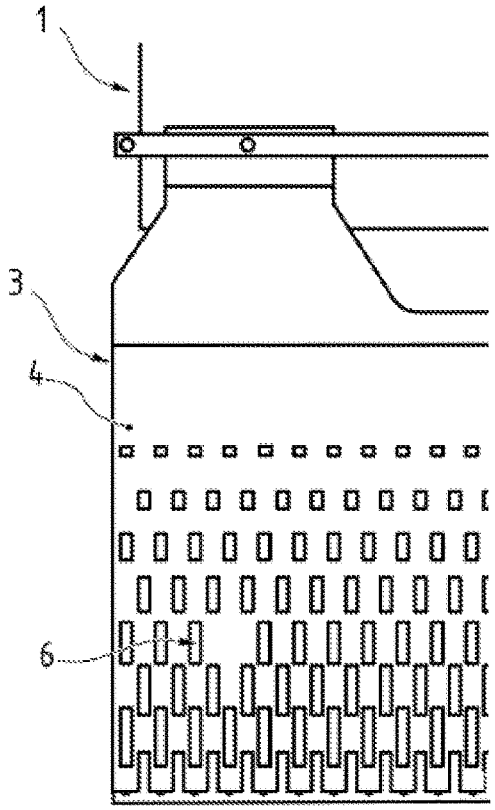
FIG. 9 illustrates a partial side view of one embodiment, showing a plate mobile in a vertical direction, in a position blocking all the orifices of a manifold, the adjacent rows of orifices of which are offset.
Figure 10:
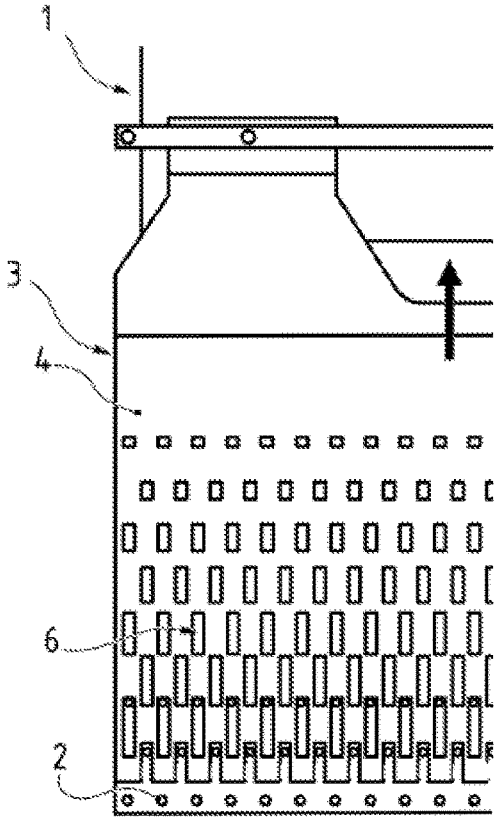
FIG. 10 the plate of FIG. 9 after a vertical movement, in a second blocking position.

Said plate 4 may be situated inside but preferably outside said manifold 1. The plate 4 is made mobile in at least one direction of movement relative to said wall of said manifold 1. This movement is preferably a movement in translation. In one embodiment, as can be seen in FIGS. 3 to 5, said plate 4 is mobile in a vertical direction. In another embodiment, as can be seen in FIGS. 7 and 8, said plate 4 is mobile in a horizontal direction. In the case of a plate 4 positioned against the wall of the manifold 1, the movement is effected by sliding of the one against the other. With such sliding contact, air passing through the orifices 2 is or is not able to circulate between the wall and the plate 4.

Thus it is possible to move the plate 4 in a horizontal or vertical direction, or alternately vertically or horizontally, or in a combined manner with a horizontal component and a vertical component contributing to an inclined or slanted movement.

Figure 12:
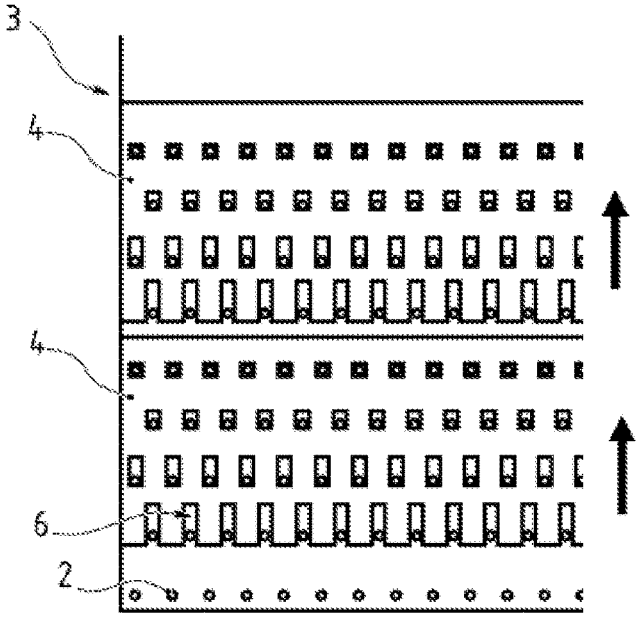
FIG. 12 illustrates a partial view of one embodiment, showing two plates for blocking the orifices of a manifold, in a blocking position.

According to one embodiment, the blocking means 3 comprise a plate 4 for each wall of a manifold 1 provided with the orifices 2. According to another embodiment, the blocking means 3 comprise a plurality of plates 4 that are juxtaposed, in particular juxtaposed vertically as can be seen in FIG. 12; a plurality of plates 4 in particular enables reduction of the travel of each of them and independent control of their movement.

Figure 6:
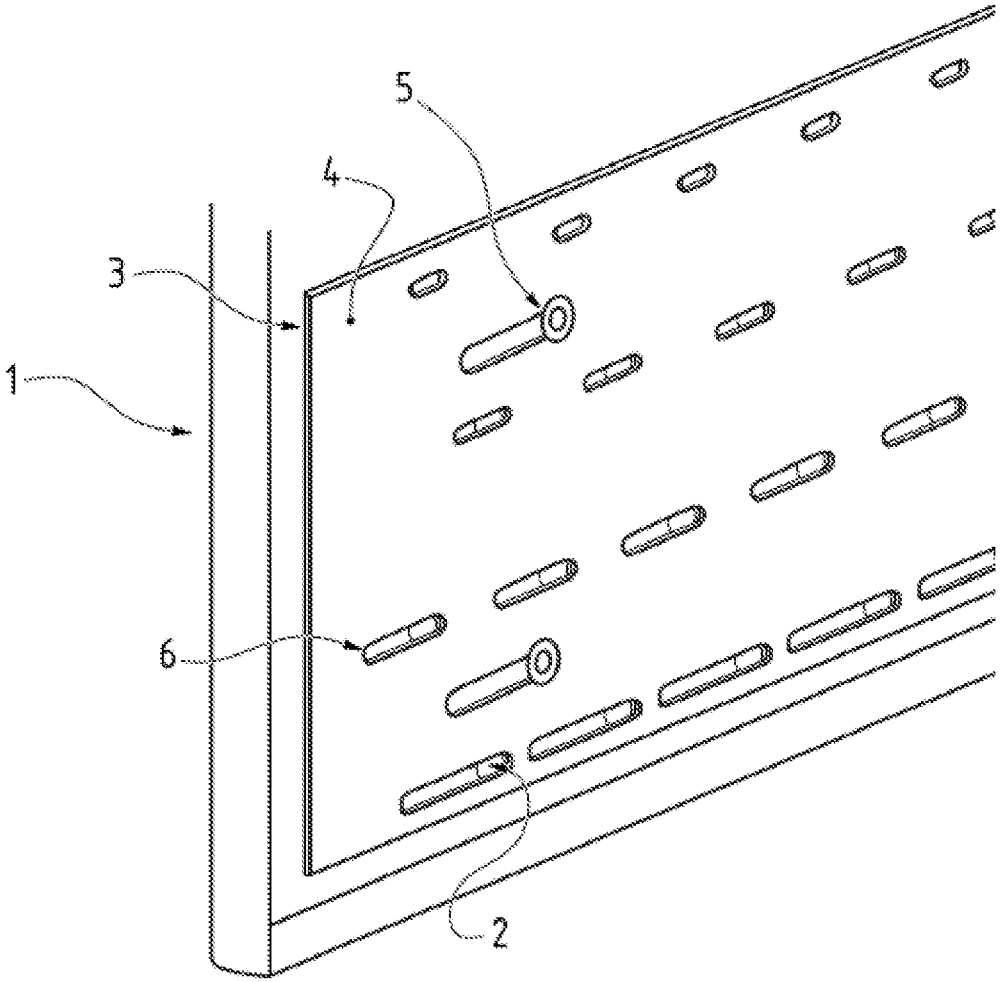
FIG. 6 illustrates a partial perspective view of another embodiment, showing a blocking plate mobile in a horizontal direction of movement relative to the wall of a ramp having offset adjacent lines of orifices in the form of rows.

Moreover, the blocking means 3 may comprise means 5 for guiding said plate 4 relative to said wall. As can be seen in the FIG. 6 embodiment, said guide means 5 may comprise at least one oblong or elongate, in particular rectilinear, hole formed through said plate 4, each hole having passed through it a lug fixed relative to said wall; the movement of the plate 4 then follows the restriction of the shape of said hole, the lug sliding inside the hole from one to the other of its ends. According to other embodiments, not represented, said plate 4 may be mounted on guide rails, in particular situated at the edge of the corresponding wall of the manifold 1.

Said movement of said plate 4 may be effected by means of specific actuators, in particular positioned laterally or in the top part of said manifold 1. Moreover, the same actuator may simultaneously control the movement of one or more plates 4, in particular of two plates situated on either side of the two lateral walls of the same plate 4.

Furthermore, said plate 4 comprises for each line of orifices 2 openings 6 spaced in accordance with an interval.

Each opening 6 has a length at least equivalent to the size of an orifice 2. To summarize, an opening 6 may have one of its dimensions slightly less than, but preferably at least greater than the size of a corresponding orifice 2.

In this regard, the openings 6 are distributed in substantially the same configuration as the distribution of the orifices 2 of the corresponding wall.

Thus, movement in one direction of the plate 4 enables the openings 6 to be positioned face-to-face with the corresponding orifices 2, allowing air to pass through said orifices 2 and said openings 6, which are then aligned. Movement in the opposite direction enables blocking of the orifices 2, the material of the plate 4 situated on one side of an opening 6 then coming to block the corresponding orifice 2.

Preferably, for each line of orifices 2, said corresponding openings 6 form an alignment in said direction of movement of said plate 4 or transversely to said direction of movement of said plate 4.

According to one embodiment, said plate 4 is mobile vertically in said direction of movement and each alignment of openings 6 then corresponds to each column, as can be seen in particular in FIGS. 3 to 5. According to another embodiment, as can be seen in FIGS. 7 and 8, said plate 4 is mobile horizontally in said direction of movement, each alignment of openings 6 corresponding to each row.

Advantageously, the invention teaches enabling the blocking of at least one line of orifices 2, preferably each line one by one. Moreover, the invention teaches limiting the travel of the movement of said plate 4 during passage from a position of opening one line to a position of blocking that same line, and vice-versa. The passage to open or block all the lines then also results in a reduced travel.

To do this, at least two successive openings 6 have different lengths, to go in said direction of movement a) from a position blocking at least a first line of orifices 2 and opening at least a second line of orifices 2, b) to another position opening said first line of orifices 2 whilst keeping said second line of orifices 2 open.

Conversely, passage in the direction of movement in the opposite direction enables passage from the position opening said first and second lines to a position blocking said first line whilst keeping the orifices of said second line open.

According to a preferred embodiment, as previously mentioned, for each line of orifices 2, said corresponding openings 6 form an alignment in said direction of movement of said plate 4 or transversely to said direction of movement of said plate 4. Said at least two successive openings 6 with different lengths then belong to the same alignment.

As can be seen in the embodiment from FIGS. 3 to 5, the plate 4 is mobile vertically and the openings 6 form an alignment in columns in said direction of vertical movement. Thus the first row of openings 6 situated higher up has a vertically oriented dimension smaller than the dimension of the second row of openings 6 situated lower down.

According to the embodiment that can be seen in FIGS. 7 and 8, the plate 4 is mobile horizontally and the opening 6 form an alignment in rows in said direction of horizontal movement. Thus the first row of openings situated higher up has a dimension smaller than the dimension of the openings 6 of the second row situated underneath, which itself has a dimension of openings 6 smaller than the dimension of the openings 6 of the last row situated at the bottom.

Preferably, the interval between at least the openings 6 corresponding to two successive lines of orifices is a function of said at least one centre distance and of at least one of the sizes of an orifice 2 from said two lines.

In particular, said interval may be equivalent to said at least one centre distance reduced by one of the sizes of an orifice 2 of one of said two lines.

According to the preferred embodiment, for at least one first line and a successive second line of orifices 2, the openings 6 corresponding to said second line have a length equivalent to the length of the openings corresponding to said first line, increased by at least one of the sizes of an orifice 2 of one of said first or second lines. In particular, for a first line having a size of openings 6 equivalent to the size of the corresponding orifices 2, then the second line of openings 6 may have dimensions equivalent to twice the dimensions of said orifices 2.

Moreover, in the context of the present invention, it is possible to adapt the various dimensions, in particular the length of the openings 6 and the centre distance between the openings 6, by a few millimetres (mm), in particular by plus or minus 1 to 5 mm. This adaptation enables a tolerance to be offered in the possible stopping positions during movement of the plate 4, facilitating the opening or the blocking of one or more orifices 2. Such a tolerance achieves complete opening of at least one required line while one or more others remain entirely closed, and vice-versa.

According to another embodiment, said plate 4 is mobile horizontally in said direction of movement, each alignment of openings 6 corresponding to each column, and the lengths of the openings 6 extend horizontally.

As can be seen in the embodiments from FIGS. 9 to 12, the openings 6 corresponding to one of the lines of orifices 2 discharge through an edge of said at least one plate 4.

It is then possible, by moving the plate 4 by one step, to open or to close the lines of orifices 2 one by one. Preferably, said plate 4 is mobile by one movement step at least equivalent to said size of the orifices 2.

Of course, as a function of the configuration, the invention may be such that the interval between the openings 6 of the same alignment and the lengths of the openings 6 are adapted as a function of the centre distances between the orifices 2 and of the sizes of the orifices 2, in order to adapt thereto and to enable opening and blocking of a line by movement of the plate 4 by its movement step.

It will be noted that it is then possible to open or to close a plurality of orifices 2 by moving the plate 4 by as many steps. The plate 4 can then move to a plurality of intermediate positions and each position opens or closes a line (column or row) of orifices 2.

With the specific configuration of the openings 6 of the plate 4, the amplitude of travel then corresponds to the sum of the sizes of its orifices 2 in each line.

The invention also concerns an installation for packaging by film wrapping batches of products, comprising successively at least:

- a station for grouping said products into batches;
- a station for wrapping each of said batches using a sheet of heat-shrink film;
- a station for heating each sheet wrapping each batch;
- a station for cooling the sheet of each batch.

Advantageously, said installation comprises at least one device for heating wrapped batches of products as described above.

What is claimed is:

1. Device for heating wrapped batches of products, comprising:

- an oven provided with at least one section;
- at least one conveyor of said wrapped products passing through said at least one section;
- means for heating said at least one section;
- for each section, the heating means comprising at least one manifold (1) extending along at least a part of said corresponding section;
- said at least one manifold (1) comprising at least one wall provided with orifices (2) of equivalent sizes, said orifices (2) being distributed in lines on the surface of said wall, the lines of orifices (2) extending horizontally forming rows, the lines of orifices extending vertically forming columns, the adjacent orifices (2) of the same line being spaced by at least one particular centre distance;
- at least one means (3) for blocking the orifices (2) of at least two of the lines comprising at least one plate (4) mobile in at least one direction of movement relative to said wall of said manifold (1), said plate (4) comprising openings (6) spaced by an interval corresponding with each line of the orifices (2), each of the openings (6) having a length at least equivalent to the size of the orifice (2);

wherein:

- at least two of the successive openings (6) have different lengths, to go in said movement direction
- a) from a position blocking at least a first line of orifices (2) and opening at least a second line of orifices (2),
- b) to another position opening said first line of orifices (2) whilst maintaining open said second line of orifices (2).

2. The heating device according to claim 1, wherein:

for each of the line of orifices (2), said corresponding openings (6) form an alignment in said direction of movement of said plate (4) or transversely to said direction of movement of said plate (4); and said at least two successive openings (6) with different lengths belong to the same alignment.

3. The heating device according to claim 2, wherein the interval between the openings (6) of the same alignment and the length of the openings (6) are adapted as a function of the centre distances between the orifices (2) and the sizes of the orifices (2).

4. The heating device according to claim 1, wherein the interval between at least the openings (6) corresponding to the two successive lines of orifices (2) is a function of said at least one centre distance and at least one of the sizes of an orifice (2) of said two lines.

5. The heating device according to claim 4, wherein said interval is equivalent to said at least one centre distance, reduced by one of the sizes of an orifice (2) of one of said two lines.

6. The heating device according to claim 1, wherein for at least the first and second successive lines of orifices (2), the openings (6) corresponding to said second line have a length equivalent to the length of the openings (6) corresponding to said first line, increased at least by one of the sizes of an orifice (2) of one of said first or second lines.

7. The heating device according to claim 1, wherein said plate (4) is mobile vertically in said direction of movement, each alignment of the openings (6) corresponding to each of the columns.

8. The heating device according to claim 1, wherein said plate (4) is mobile horizontally in said direction of movement, each alignment of the openings (6) corresponding to each of the rows.

9. The heating device according to claim 1, wherein said plate (4) is mobile horizontally in said direction of movement, each alignment of the openings (6) corresponding to each of the columns, and in that the lengths of the openings (6) extend horizontally.

10. The heating device according to claim 1, wherein the orifices (2) of two of the adjacent rows (or columns) are offset horizontally (or vertically).

11. The heating device according to claim 1, wherein the openings (6) corresponding to one of the lines of orifices (2) discharge through an edge of said plate (4).

12. The heating device according to claim 1, wherein said plate (4) is mobile by a movement step at least equivalent to the size of the orifices (2).

* * * * *